US005581823A

United States Patent [19]

Kuo

[11] Patent Number: 5,581,823

[45] Date of Patent: Dec. 10, 1996

[54] AUTOMATIC DETERGENT DISPENSER FOR A URINE BOWL

[76] Inventor: Chung Y. Kuo, No. 1058, Scetion 1, Chung-San Rd. Tachia, Taichung Hsien, Taiwan

[21] Appl. No.: 563,497

[22] Filed: Nov. 28, 1995

[51] Int. Cl.[6] ..... E03D 9/02; E03D 9/03

[52] U.S. Cl. ..... 4/226.1; 4/309; 4/224

[58] Field of Search ..... 4/301, 304, 306, 4/309, 226.1, 222, 223, 224

[56] References Cited

U.S. PATENT DOCUMENTS

| | | | |
|---|---|---|---|
| 598,103 | 2/1898 | La Fave | 4/226.1 |
| 1,664,736 | 4/1928 | Creamer et al. | 4/309 |

FOREIGN PATENT DOCUMENTS

| | | | |
|---|---|---|---|
| 1-295931 | 11/1989 | Japan | 4/309 |
| 6-228996 | 8/1994 | Japan | 4/226.1 |

*Primary Examiner*—David J. Walczak
*Assistant Examiner*—Charles R. Eloshway
*Attorney, Agent, or Firm*—Morton J. Rosenberg; David I. Klein

[57] ABSTRACT

An automatic detergent dispenser includes an accommodating member mounted on a top of and communicated with a urine bowl, a water guiding member securely mounted in the accommodating member for intercommunicating the accommodating member with a water source and having a plurality of water guiding holes, a solid detergent provided in the accommodating member, and a housing for encasing the accommodating member. Most water from the water source passes through the water guiding member and the accommodating member to the urine bowl while the remaining water passes through the water guiding holes to contact with and thus dissolve part of the solid detergent, and the dissolved detergent merges with the most of the flushing water after passing through the accommodating member and flows into the urine bowl for flushing purpose.

16 Claims, 4 Drawing Sheets

AUTOMATIC DETERGENT DISPENSER FOR A URINE BOWL

BACKGROUND OF THE INVENTION

1. Field of the Invention

The present invention relates to an automatic detergent dispenser for a urine bowl and, more particularly, to a dispenser which contains a solid detergent.

2. Description of Related Art

A wide variety of proposals have been made so as to provide a clean, fragrant urine bowl, especially for extensively used public urine bowls. A most commonly used agent to flush the urine is water, and a plurality of multi-stage flush systems, automatic or manual, have been proposed for public urine bowls, yet the result thereof is unsatisfactory and a common disadvantage thereof is that urinary sediment has to be removed by using additional detergent periodically. Ice and/or deodorant are directly added into the urine bowl to try to eliminate the odor of urine, yet the result is also poor in addition to being troublesome. A frequent supply of ice is required as it melts quickly while urinary sediment tends to stick to the deodorant and thus results in disgusting feeling to the user as well as unsanitary condition, and accordingly additional detergent is still required.

Automatic liquid detergent dispensers for urine bowls have been proposed to solve the above-mentioned problems, yet other problems have been arisen, e.g., containers are required for the liquid detergent, and sometimes they are bulky and heavy and thus cause inconvenience in transportation, carriage and installation, especially for women. In addition, loss of detergent occurs easily after it is put into the automatic dispenser as it is liquid, and it is, of course, a waste. Furthermore, sealing means has to be provided to provide a sealing effect which complicates the dispenser structure.

Therefore, there has been a long and unfulfilled need for an improved detergent dispenser for urine bowls.

SUMMARY OF THE INVENTION

An automatic detergent dispenser for a urine bowl in accordance with the present invention includes an accommodating member mounted on a top of and communicated with the urine bowl, a water guiding member securely mounted in the accommodating member for intercommunicating the accommodating member with a water source and having a plurality of water guiding holes, a solid detergent provided in the accommodating member, and a housing for encasing the accommodating member. Most water from the water source passes through the water guiding member and the accommodating member to the urine bowl while the remaining water passes through the water guiding holes to contact with and thus dissolve part of the solid detergent, and the dissolved detergent merges with the most of the flushing water after passing through the accommodating member and then flows into the urine bowl for flushing purpose.

In accordance with one aspect of the invention, the top of the urine bowl comprises a through hole therein, and the dispenser further includes a positioning sleeve which is generally "T" shaped in section with a longitudinal bore extending therethrough and has an upper section resting on the top of the bowl and a reduced lower section securely received in the through hole. The accommodating member includes a cylindrical section with an open upper end and a lower end and a first tube of reduced diameter extending downwardly from the lower end of the cylindrical section and received in the longitudinal bore of the positioning sleeve.

The cylindrical section of the accommodating member further comprises a plurality of protrusions formed on a bottom surface thereof and each of which has a threaded hole therein, and the water guiding means comprises a corresponding number of screw holes for secure engagement with the accommodating member by screws.

In accordance with another aspect of the invention, the water guiding means comprises a disc having a plurality of openings therein through which the dissolved detergent passes and a second tube extending upwardly from the disc and beyond the accommodating member, the first and second tubes aligning with each other. The second tube includes an inner annular flange formed on an inner periphery of a lower section thereof and the above-mentioned guiding holes are radial and defined in the second tube above the inner flange, the inner annular flange being at a level the same as that of the disc.

Preferably, each of the guiding holes gradually increases in diameter from an inner end thereof to an outer end thereof. Preferably, the disc of the water guiding means includes at least one recessed area in an upper side thereof to retain dissolved detergent for a subsequent flush.

In accordance with a further aspect of the invention, the dispenser further comprises a detergent support mounted in the accommodating member and around the second tube of the water guiding means for supporting the solid detergent thereon, the detergent support including an inner ring, an outer ring and a mesh-like structure between the inner and outer rings and defining apertures therein, the inner ring having an inner diameter Substantially the same as an outer diameter of the second tube, and the outer diameter of the outer ring is substantially the same as an inner diameter of the cylindrical member of the accommodating member, the detergent support being mounted at a level higher than the radial guiding holes of the water guiding means.

Preferably, the outer ring of the detergent support includes a downwardly extending skirt to keep the detergent support at a desired height, and the mesh-like structure of the detergent support is dome-shaped.

Preferably, the housing is bell shaped and includes an opening in a top thereof and the second tube of the water guiding means includes a ratchet-like structure on an upper section of an outer periphery thereof and extending beyond the opening of the housing for secure engagement with a hose which is communicated to the water source.

Other objects, advantages, and novel features of the invention will become more apparent from the following detailed description when taken in conjunction with the accompanying drawings.

DESCRIPTION OF THE PREFERRED EMBODIMENT

Figure 1:
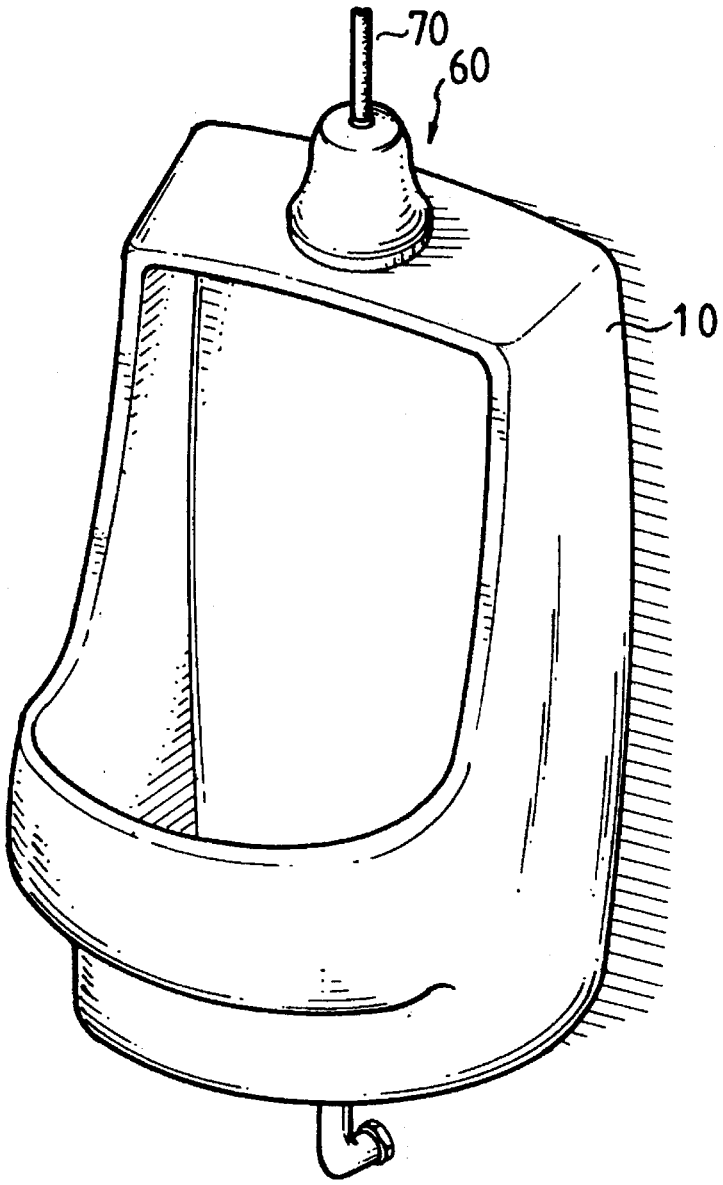
FIG. 1 is a perspective view of a urine bowl with an automatic detergent dispenser in accordance with the present invention.
Figure 2:
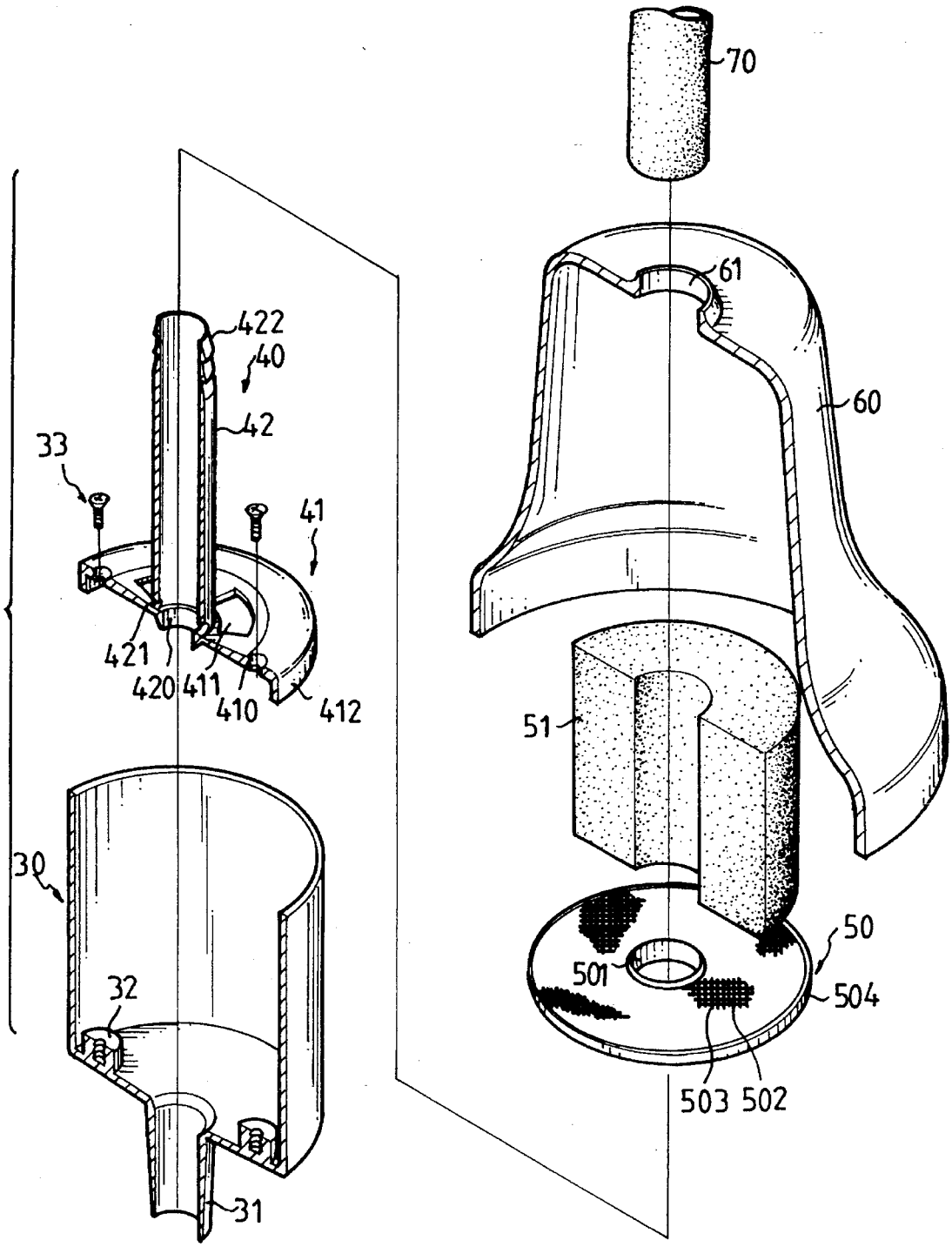
FIG. 2 is a partial exploded view, partly sectioned, of the automatic detergent dispenser in accordance with the present invention.
Figure 3:
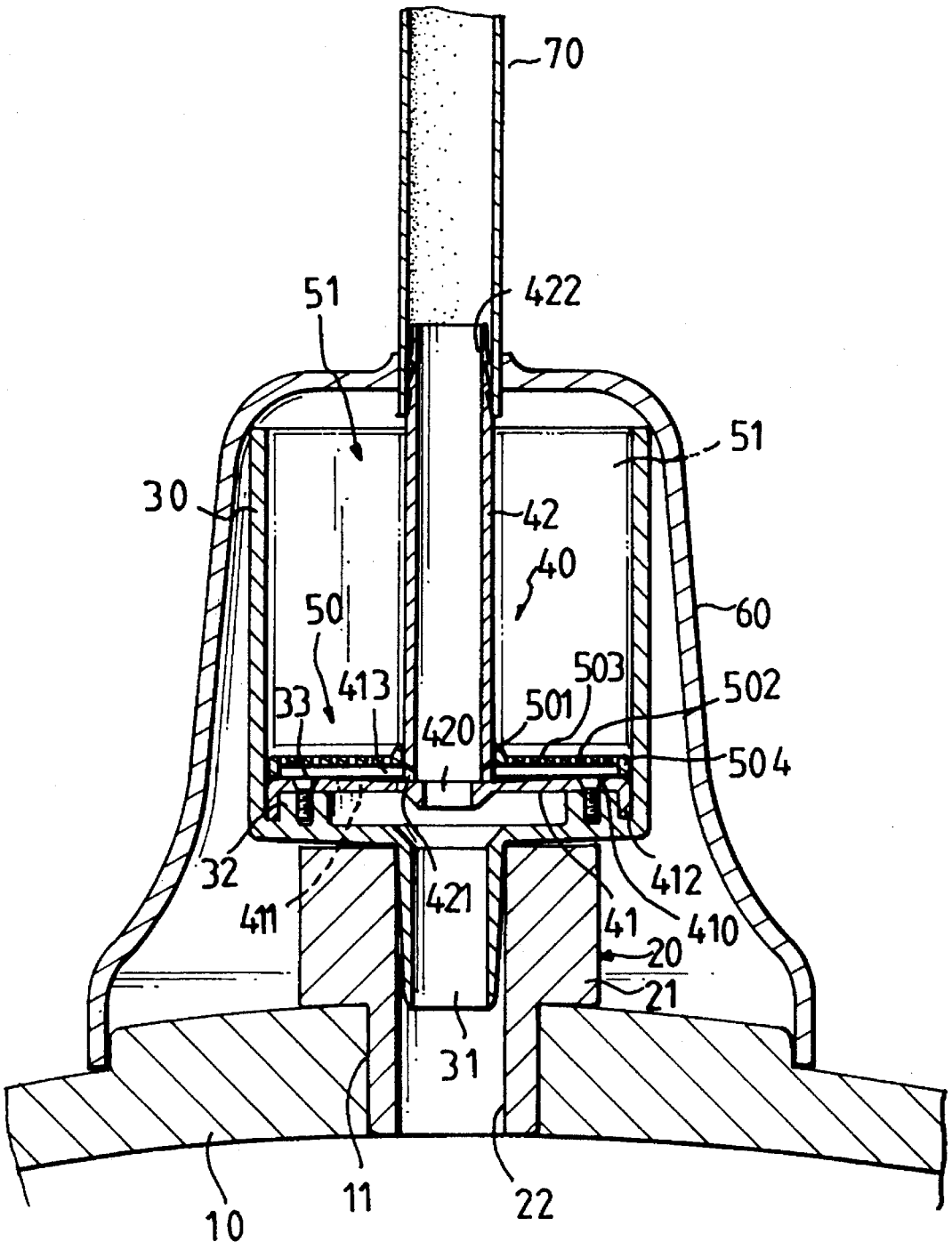
FIG. 3 is a cross-sectional view of an upper part of the urine bowl and the automatic detergent dispenser in accordance with the present invention.

Referring to the drawings and initially to FIGS. 1 through 3, an automatic detergent dispenser for a urine bowl in accordance with the present invention generally includes a positioning sleeve 20 (see FIG. 3), an accommodating member 30, a water guiding means 40, a detergent support 50, and a housing 60.

Referring to FIG. 3, a urine bowl, designated by "10", generally includes a through hole 11 in a top thereof for mounting the positioning sleeve 20. As shown in FIG. 3, the positioning sleeve 20 is generally "T" shaped in section with a longitudinal bore 22 extending therethrough and has an upper section 21 resting on the top of the bowl 10 and a reduced lower section securely received in the through hole 11. Preferably, the upper section 21 includes a cushion material for supporting the accommodating member 30.

Figure 4:
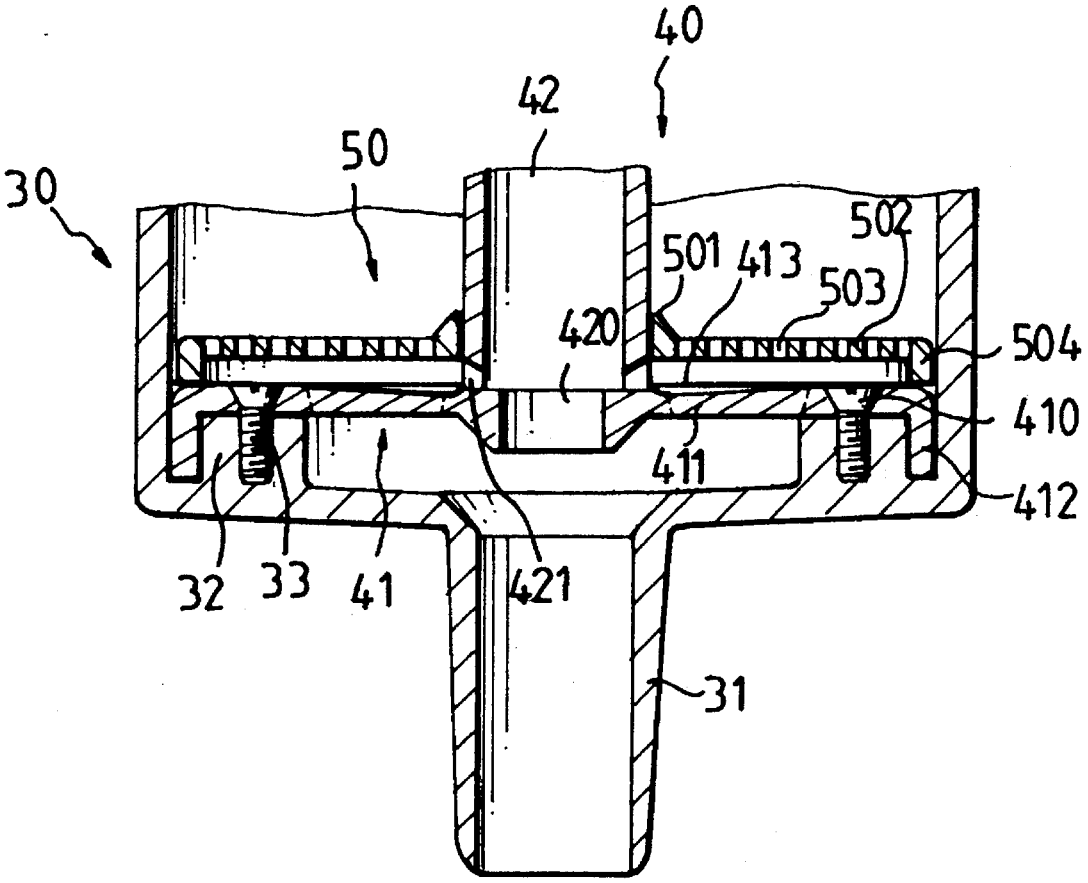
FIG. 4 is a cross-sectional view in an enlarged scale to illustrate internal construction.

As clearly shown in FIGS. 2 through 4, the accommodating member 30 includes a cylindrical section with an open upper end and a lower end and a first tube 31 of reduced diameter extending downwardly from the lower end of the cylindrical section and received in the positioning sleeve 20. A pair of protrusions 32 are formed on a bottom surface of the cylindrical section and each of which has a threaded hole (not labeled) the purpose of which will be described hereinafter.

The water guiding means 40 includes a disc 41 and a second tube 42 extending upwardly from the disc 41 and beyond the accommodating member 30, as clearly shown in FIG. 2. The disc 41 has a plurality of openings 411 defined therein and a skirt 412 formed on a periphery thereof such that the water guiding means 40 is securely mounted in the cylindrical member by means of screws 33 passing through screw holes 410 in the disc 41 and then engaging with the threaded holes in the protrusions 32 of the accommodating member 30, as best shown in FIGS. 3 and 4. The first and second tubes 31 and 42 align with each other after assembly for intercommunication. The second tube 42 includes an inner annular flange 420 formed on an inner periphery of a lower section thereof and a plurality of radial guiding holes 421 are defined in the wall of the second tube 42 above the inner flange 420. Preferably, the inner annular flange 420 is at a level the same as that of the disc 41. Preferably, each guiding hole 421 gradually increases in diameter from an inner end thereof (which communicates with an inner side of the second tube 42) to an outer end thereof (which communicates with a space defined between the disc 41 and the detergent support 50). The second tube 42 further includes a ratchet-like structure 422 on an upper section of an outer periphery thereof for secure engagement with the hose 70.

The detergent support 50 is circular and includes a central through hole (not labeled) defined by an inner ring 501, a rigid peripheral ring 504, and a mesh-like structure 502 with apertures 503 enclosed by the rigid peripheral ring 504. The detergent support 50 is mounted on the upper side of the disc 41 with the second tube 42 extending through the central through hole defined by the inner ring 501. Preferably, the inner ring 501 has an inner diameter substantially the same as an outer diameter of the second tube 42, and the outer diameter of the detergent support 50 is substantially the same as an inner diameter of the cylindrical member of the accommodating member 30. Preferably, the detergent support 50 is mounted at a level higher than the radial guiding holes 421. The outer ring 504 may have downwardly extending skirt to keep the detergent support 50 at a desired height. A solid detergent 51, preferably semi-cylindrical (see FIG. 2), is placed on the detergent support 50. Preferably, the mesh-like structure 502 is dome-shaped to provide more efficient contact with the solid detergent 51 such that the solid detergent may dissolve more effectively when contacting with water.

The housing 60 is preferably bell shaped and includes an opening 61 in a top thereof and houses the positioning sleeve 20 and the accommodating member 30 with the second tube 42 extending beyond the opening 61 thereof for engaging with a hose 70 which, in turn, communicates with a water source for flushing.

In use, referring to FIGS. 3 and 4, when water enters the second tube 42 via the hose 70, some of the incoming water enters the space defined between the disc 41 and the detergent support 50 via the radial holes 421, and some of the water which enters the above-mentioned space splashes upwardly and passes through the mesh-like structure 502 of the detergent support 50 and thus dissolves the solid detergent 51. The dissolved detergent falls via the openings 411 in the disc 41 and then enters the first tube 31 via another space defined between a bottom surface of the cylindrical member and the disc 41, thereby merging into the main water stream from the hose 70 for flushing urine in the bowl. Preferably, as shown in FIG. 4, the disc 41 may include at least one recessed area 413 in an upper side thereof and adjacent to a center thereof such that a certain amount of dissolved detergent may be retained in the recessed area 413, and such retained dissolved detergent shall be carried away by the next flush water stream, thereby providing a more reliable deodorization effect.

According to the above description, it is appreciated that the automatic detergent dispenser in accordance with the present invention includes the following advantages:

(1) easy supply and automatic dispensing of detergent: The worker may simply lift the housing 60 upwardly along the hose 70 to expose the accommodating member 30, place a new solid detergent in position if the existing solid detergent has nearly expired, and re-position the housing 60, while the detergent is dispensed automatically.

(2) better utility: The detergent used herein is solid and thus is easy to carry and transport, saving the cost therefor. Fewer containers are consumed, thereby reducing environmental problems.

(3) easy assembly: Very few members are used in the present automatic detergent dispenser and they can be quickly and easily assembled, while no sealing means are required in this design, providing a low cost product as the manufacturing time and cost and assembling labor are saved.

(4) pleasant appearance: The whole detergent dispenser is housed in the bell-shaped housing without affecting the appearance. As a result, urinary sediment does not accumulate in the bowl which is thus very easy to clean. Furthermore, the recessed area assures that a certain amount of preserved dissolved detergent tube is to be flushed for deodorization purpose and therefore no additional ice and/or fragrant and deodorant are required.

Although the invention has been explained in relation to its preferred embodiment, it is to be understood that many other possible modifications and variations can be made without departing from the spirit and scope of the invention as hereinafter claimed.

What is claimed is:

1. An automatic detergent dispenser for a urine bowl having a top, the dispenser comprising:

an accommodating member adapted to be mounted on the top of and communicated with the urine bowl, said accommodating member comprising a cylindrical section with an open upper end and a lower end and a first tube of reduced diameter extending downwardly from the lower end of the cylindrical section;

a water guiding means securely mounted in the accommodating member for intercommunicating the accommodating member with a water source and having a plurality of water guiding holes, the water guiding means comprising a disc and a second tube extending upwardly from the disc and beyond the accommodating member, the disc including a plurality of openings defined therein, the first and second tubes aligning with each other and said second tube including an inner annular flange formed on an inner periphery of a lower section thereof, the guiding holes further being radial and defined in the second tube above the inner flange, the inner annular flange being at a level the same as that of the disc;

a solid detergent provided in the accommodating member;

a housing for encasing the accommodating member; and, a positioning sleeve which is generally "T" shaped in section with a longitudinal bore extending therethrough and having an upper section adapted for resting on the top of the bowl and a reduced lower section adapted to be securely received in a through hole extending through the top of the urine bowl, the longitudinal bore receiving the first tube;

whereby most water from the water source passes through the water guiding means and the accommodating member to the urine bowl while the remaining water passes through the water guiding holes to contact with and thus dissolve part of the solid detergent, the dissolved detergent passes though the plurality of holes in the disc and then merges with the most of the flushing water after passing through the accommodating member and then flows into the urine bowl for flushing it.

2. The dispenser as claimed in claim 1, wherein the cylindrical section of the accommodating member further comprises a plurality of protrusions formed on a bottom surface thereof and each of which has a threaded hole therein, and the water guiding means comprises a corresponding number of screw holes for secure engagement with the accommodating member by screws.

3. The dispenser as claimed in claim 2, wherein:

the water guiding means comprises a disc and a second tube extending upwardly from the disc and beyond the accommodating member, the disc includes a plurality of openings defined therein through which the dissolved detergent passes and the first and second tubes align with each other;

the second tube includes an inner annular flange formed on an inner periphery of a lower section thereof and the guiding holes are radial and defined in the second tube above the inner flange, the inner annular flange being at a level the same as that of the disc.

4. The dispenser as claimed in claim 3, wherein each of the guiding holes gradually increases in diameter from an inner end thereof to an outer end thereof.

5. The dispenser as claimed in claim 3, wherein the second tube further includes a ratchet-like structure on an upper section of an outer periphery thereof for secure engagement with a hose which is communicated to the water source.

6. The dispenser as claimed in claim 3, further comprising a detergent support mounted in the accommodating member and around the second tube of the water guiding means for supporting the solid detergent thereon, the detergent support including an inner ring, an outer ring and a mesh-like structure between the inner and outer rings and defining apertures therein, the inner ring having an inner diameter substantially the same as an outer diameter of the second tube, and the outer diameter of the outer ring is substantially the same as an inner diameter of the cylindrical member of the accommodating member, the detergent support being mounted at a level higher than the radial guiding holes of the water guiding means.

7. The dispenser as claimed in claim 6, wherein the outer ring of the detergent support includes a downwardly extending skirt to keep the detergent support at a desired height.

8. The dispenser as claimed in claim 7, wherein the mesh-like structure of the detergent support is dome-shaped.

9. The dispenser as claimed in claim 3, wherein the housing is bell shaped and includes an opening in a top thereof and the second tube of the water guiding means includes a ratchet-like structure on an upper section of an outer periphery thereof and extending beyond the opening of the housing for secure engagement with a hose which is communicated to the water source.

10. The dispenser as claimed in claim 3, wherein the disc of the water guiding means includes at least one recessed area in an upper side thereof to retain dissolved detergent for next flush.

11. The dispenser as claimed in claim 1, wherein each of the guiding holes gradually increases in diameter from an inner end thereof to an outer end thereof.

12. The dispenser as claimed in claim 1, wherein the second tube further includes a ratchet-like structure on an upper section of an outer periphery thereof for secure engagement with a hose which is communicated to the water source.

13. The dispenser as claimed in claim 1, further comprising a detergent support mounted in the accommodating member and around the second tube of the water guiding means for supporting the solid detergent thereon, the detergent support including an inner ring, an outer ring and a mesh-like structure between the inner and outer rings and defining apertures therein, the inner ring having an inner diameter substantially the same as an outer diameter of the second tube, and the outer diameter of the outer ring is substantially the same as an inner diameter of the cylindrical member of the accommodating member, the detergent support being mounted at a level higher than the radial guiding-holes of the water guiding means.

14. The dispenser as claimed in claim 13, wherein the outer ring of the detergent support includes a downwardly extending skirt to keep the detergent support at a desired height.

15. The dispenser as claimed in claim 14, wherein the mesh-like structure of the detergent support is dome-shaped.

16. The dispenser as claimed in claim 1, wherein the housing is bell shaped and includes an opening in a top thereof and the second tube of the water guiding means includes a ratchet-like structure on an upper section of an outer periphery thereof and extending beyond the opening of the housing for secure engagement with a hose which is communicated to the water source.

* * * * *